US010174398B2

(12) United States Patent
Watson et al.

(10) Patent No.: US 10,174,398 B2
(45) Date of Patent: Jan. 8, 2019

(54) WEATHERING STEEL

(71) Applicant: Nucor Corporation, Charlotte, NC (US)

(72) Inventors: James W. Watson, Brownsburg, IN (US); Tao Wang, Manila, AR (US); Eric Young, Richwood, OH (US); Chad Baudendistel, Charlotte, NC (US)

(73) Assignee: NUCOR CORPORATION, Charlotte, NC (US)

( * ) Notice: Subject to any disclaimer, the term of this patent is extended or adjusted under 35 U.S.C. 154(b) by 299 days.

(21) Appl. No.: 15/049,461

(22) Filed: Feb. 22, 2016

(65) Prior Publication Data

US 2017/0240992 A1 Aug. 24, 2017

(51) Int. Cl.
*C22C 38/42* (2006.01)
*C22C 38/48* (2006.01)
(Continued)

(52) U.S. Cl.
CPC ..... *C21D 9/52* (2013.01); *B22D 11/0622* (2013.01); *B22D 11/0642* (2013.01);
(Continued)

(58) Field of Classification Search
None
See application file for complete search history.

(56) References Cited

U.S. PATENT DOCUMENTS 9,149,868 B2 10/2015 Williams et al.
2014/0366602 A1 12/2014 Fang et al.
(Continued)

FOREIGN PATENT DOCUMENTS

CN 10330225 A 9/2013
CN 103305759 A 9/2013
CN 103305770 A 9/2013

OTHER PUBLICATIONS

ASTM A606, Standard Specification for Steel, Sheet and Strip, High-Strength, Low-Alloy, Hot-Rolled and Cold-Rolled, with Improved Atmospheric Corrosion Resistance, as downloaded from astm.org on Sep. 22, 2016, 4 page.
(Continued)

*Primary Examiner* — Deborah Yee

(74) *Attorney, Agent, or Firm* — Hahn Loeser & Parks LLP

(57) ABSTRACT

A method of making weathering steel by preparing a molten melt producing an as-cast carbon alloy steel strip with a corrosion index of at least 6.0 comprising, by weight, 0.02%-0.08% carbon, <0.6% silicon, 0.2%-2.0% manganese, <0.03% phosphorus, <0.01% sulfur, <0.01% nitrogen, 0.2%-0.5% copper, 0.01%-0.2% niobium, 0.01%-0.2% vanadium, 0.1%-0.4% chromium, 0.08%-0.25% nickel, <0.01% aluminum, and the remainder iron and impurities. The molten melt is solidified and cooled into a cast strip ≤4 mm in thickness in a non-oxidizing atmosphere. The strip is hot rolled in an austenitic temperature range above $Ar_3$ to between 10% and 50% reduction, cooled at above 20° C./s and coiled below 700° C. to form a steel strip with a microstructure comprising bainite and acicular ferrite with more than 70% niobium in solid solution. Then, age hardening the strip resulting in a yield strength of at least 550 MPa and a total elongation of at least 8%.

20 Claims, 4 Drawing Sheets

(51) Int. Cl.

| | |
|---|---|
| ***C22C 38/58*** | (2006.01) |
| ***C21D 8/02*** | (2006.01) |
| ***C21D 9/52*** | (2006.01) |
| ***B22D 11/06*** | (2006.01) |
| ***B22D 11/11*** | (2006.01) |
| ***B22D 11/113*** | (2006.01) |
| ***C21D 1/18*** | (2006.01) |
| ***C22C 38/00*** | (2006.01) |
| ***C22C 38/02*** | (2006.01) |
| ***C22C 38/06*** | (2006.01) |
| ***C22C 38/46*** | (2006.01) |

(52) U.S. Cl.

CPC ..... *B22D 11/0651* (2013.01); *C21D 1/18* (2013.01); *C21D 8/021* (2013.01); *C21D 8/0205* (2013.01); *C21D 8/0226* (2013.01); *C21D 8/0263* (2013.01); *C22C 38/002* (2013.01); *C22C 38/02* (2013.01); *C22C 38/06* (2013.01); *C22C 38/42* (2013.01); *C22C 38/46* (2013.01); *C22C 38/48* (2013.01); *C22C 38/58* (2013.01)

(56) References Cited

U.S. PATENT DOCUMENTS

2014/0373981 A1 12/2014 Wang et al.
2015/0007913 A1 1/2015 Wang et al.

OTHER PUBLICATIONS

ASTM G101, Standard Guide for Estimating the Atmospheric Corrosion Resistance of Low-Allow Steels, as downloaded from astm.org on Sep. 22, 2016, 9 pages.

| Coil | Gauge (mm) | Location | Yield Strength (MPa) | Tensile Strength (MPa) | Elongation (%) |
|---|---|---|---|---|---|
| #1 | 1.1 | Before Age-Hardening | 641 | 731 | 9 |
| | | After Age-Hardening | | | |
| | | Head | 765 | 827 | 10.4 |
| | | Center | 834 | 862 | 9 |
| | | Tail | 793 | 834 | 8.6 |
| | | *Average* | 797 | 841 | 9 |
| | | **Difference** | **156** | **110** | **0** |
| #2 | 1.1 | Before Age-Hardening | 614 | 738 | 8.9 |
| | | After Age-Hardening | | | |
| | | Head | 765 | 814 | 9.9 |
| | | Center | 786 | 827 | 10.6 |
| | | Tail | 786 | 820 | 10.4 |
| | | *Average* | 779 | 820 | 10 |
| | | **Difference** | **165** | **83** | **1** |
| #3 | 1.6 | Before Age-Hardening | 655 | 745 | 8.95 |
| | | After Age-Hardening | | | |
| | | Head | 731 | 793 | 11.9 |
| | | Center | 738 | 793 | 11.2 |
| | | Tail | 745 | 800 | 12 |
| | | *Average* | 738 | 795 | 12 |
| | | **Difference** | **83** | **51** | **3** |
| #4 | 1.6 | Before Age-Hardening | 686 | 783 | 9 |
| | | After Age-Hardening | | | |
| | | Head | 738 | 786 | 11.5 |
| | | Center | 745 | 786 | 11.3 |
| | | Tail | 731 | 800 | 9.5 |
| | | *Average* | 738 | 791 | 11 |
| | | **Difference** | **52** | **8** | **2** |

Fig. 3

WEATHERING STEEL

BACKGROUND AND SUMMARY

This invention relates to the making of weathering high strength thin cast strip, and to the method for making such cast strip by a twin roll caster.

Weathering steel is a high strength low alloy steel resistant to atmospheric corrosion. In the presence of moisture and air, low alloy steels oxidize, the rate of which depends on the access of oxygen, moisture and atmospheric contaminants to the metal surface. As the process progresses, the oxide layer forms a barrier to the ingress of oxygen, moisture and contaminants, and the rate of rusting slows down. With weathering steel, the oxidation process is initiated in the same way, but the specific alloying elements in the steel produce a stable protective oxide layer that adheres to the base metal, and is much less porous. The result is a much lower corrosion rate than would be found on ordinary structural steel.

Weathering steels are defined in ASTM A606, Standard Specification for Steel, Sheet and Strip, High Strength, Low-Alloy, Hot Rolled and Cold Rolled with Improved Atmospheric Corrosion Resistance. Weathering steels are supplied in two types: Type 2, which contains at least 0.20% copper based on cast or heat analysis (0.18% minimum Cu for product check); and Type 4, which contains additional alloying elements to provide a corrosion index of at least 6.0 as calculated by ASTM G101, Standard Guide for Estimating the Atmospheric Corrosion Resistance of Low-Alloy Steels, and provides a level of corrosion resistance substantially better than that of carbon steels with or without copper addition.

Weathering steel's yield strength allows cost reduction through the ability to design lighter sections into structures. In the past, high strength weathering low-carbon thin strip has been made by recovery annealing of cold rolled strip. Cold rolling was required to produce the desired thickness. The cold rolled strip was then recovery annealed to improve ductility without significantly reducing the strength. However, the final ductility of the resulting strip still was relatively low and the strip would not achieve total elongation levels over 6%, which is required for structural steels by building codes. Such recovery annealed cold rolled, low-carbon steel was generally suitable only for simple forming operations, e.g., roll forming and bending. To produce this steel strip with higher ductility was not technically feasible in these final strip thicknesses using the cold rolled and recovery annealed manufacturing route.

High strength weathering low-carbon steel strip has also been made by microalloying with elements such as niobium (Nb), vanadium (V), titanium (Ti) or molybdenum (Mo), and hot rolling to achieve the desired thickness and strength level. Additions of nickel (Ni), copper (Cu) and silicon (Si) to the microalloying were used to obtain the corrosion-resistance properties. Microalloying required expensive and high levels of niobium, vanadium, titanium or molybdenum and resulted in formation of a bainite-ferrite microstructure typically with 10% to 20% bainite. Alternately, the microalloying could result in formation of a ferrite microstructure with 10% to 20% pearlite.

Hot rolling the strip resulted in the partial precipitation of these alloying elements. As a result, relatively high alloying levels of the Nb, V, Ti or Mo elements were required to provide enough precipitation hardening of the predominately ferritic transformed microstructure to achieve the required strength levels. These high microalloying levels significantly raised the hot rolling loads needed and restricted the thickness range of the hot rolled strip that could be economically and practically produced.

As such, making of high strength low-carbon steel strip less than 4 mm in thickness with microalloying additions of Nb, V, Ti and/or Mo to the base steel chemistry has been very difficult, particularly for wide strip due to the high rolling loads, and not always commercially feasible. For thinner thicknesses of strip, cold rolling was required; however, the high strength of the hot rolled strip made such cold rolling difficult because of the high cold roll loadings required to reduce the thickness of the strip. These high alloying levels also considerably raised the recrystallization annealing temperature needed, requiring expensive to build and difficult to operate annealing lines capable of achieving the high annealing temperature needed for full recrystallization annealing of the cold rolled strip.

Addition of phosphorus is also currently used to improve machining characteristics and atmospheric corrosion resistance in steels. For example, Chinese Patent Application Publications Nos. CN103305759, CN103302255, and CN103305770, all show purposeful addition of phosphorus between 0.07% to 0.22% to improve corrosion resistance of steel composition. However, phosphorus causes embrittlement which reduces toughness and ductility. For example, phosphorus causes temper embrittlement in heat-treated low-alloy steels resulting from segregation of phosphorus and other impurities at prior austenite grain boundaries. Additionally, phosphorus content greater than 0.04% makes weld brittle and increases the tendency to crack. The surface tension of the molten weld metal is lowered, making it difficult to control.

In short, the application of previously known microalloying practices with Ni, V, Ti and/or Mo elements and the purposeful addition of phosphorus to produce high strength weathering low-carbon thin strip are not practicable methods. The high alloying costs, difficulties with high rolling loads in hot rolling and cold rolling, the high recrystallization annealing temperatures required, and phosphorus harmful effects are problems with the existing process for manufacturing high strength weathering steel. As such, there is still a need for developing an economically feasible and effective method to produce high strength weathering or corrosion-resistant thin steel.

Disclosed is a method of making weathering steel comprising the steps of: preparing a molten melt producing an as-cast carbon alloy steel strip less or equal to 4 mm in thickness with a corrosion index of at least 6.0 comprising, by weight, between 0.02% and 0.08% carbon, less than 0.6% silicon, between 0.2% and 2.0% manganese, less than 0.03% phosphorus, less than 0.01% sulfur, less than 0.01% nitrogen, between 0.2% and 0.5% copper, between 0.01% and 0.2% niobium, between 0.01% and 0.2% vanadium, between 0.1% and 0.4% chromium, between 0.08% and 0.25% nickel, less than 0.01% aluminum, and the remainder iron and impurities from making the molten melt; solidifying and cooling the molten melt into a cast strip less than or equal to 4 mm in thickness in a non-oxidizing atmosphere; hot rolling the cast strip in an austenitic temperature range above $Ar_3$ to between 10% and 50% reduction; cooling the hot rolled cast strip at above 20° C. per second; coiling the cast strip below 700° C. to form a steel strip with a microstructure comprising bainite and acicular ferrite with more than 70% niobium in solid solution; and age hardening the steel strip forming an age hardened steel strip having a yield strength of at least 550 MPa and a total elongation of at least 8%.

The age hardened steel strip may be batch annealed at a temperature greater than 450° C. between 15 and 50 hours. The age hardened steel strip by batch annealing may have a yield strength of at least 700 MPa and a total elongation of at least 8%.

Alternatively, the age hardened cast strip may be in-line annealed at a temperature between 450° C. and 800° C. for less than 30 minutes. The age hardened steel strip by in-line annealing may have a yield strength of at least 700 MPa and a total elongation of at least 8%.

Also disclosed is a method of continuously casting weathering steel comprising the steps of: assembling a pair of counter-rotatable casting rolls to form a nip there between through which a thin strip can be casted, and capable of supporting a casting pool of molten metal formed on casting surfaces of the casting rolls above the nip with a pair of confining side dams adjacent the ends of the casting rolls; assembling a delivery system with metal delivery nozzle or nozzles disposed axially above the nip and capable of discharging molten metal to form the casting pool supported on the casting rolls; solidifying the molten metal delivered from the casting pool on the casting surfaces of the casting rolls in a non-oxidizing atmosphere and forming at the nip between the casting rolls a cast strip delivered downwardly that is less than 4 mm in thickness with a corrosion index of at least 6.0 comprising, by weight, of between 0.02% and 0.08% carbon, less than 0.6% silicon, between 0.2% and 2.0% manganese, less than 0.03% phosphorus, less than 0.01% sulfur, less than 0.01% nitrogen, between 0.2% and 0.5% copper, between 0.01% and 0.2% niobium, between 0.01% and 0.2% vanadium, between 0.1% and 0.4% chromium, between 0.08% and 0.25% nickel, less than 0.01% aluminum, and the remainder iron and impurities from melting; hot rolling the cast strip in an austenitic temperature range above $Ar_3$ to between 10% and 50% reduction; cooling the hot rolled cast strip at above 20° C. per second; coiling the cast strip below 700° C. to form a steel strip with a microstructure comprising bainite and acicular ferrite with more than 70% niobium in solid solution; and age hardening the steel strip forming an age hardened steel having a yield strength of at least 550 MPa and a total elongation of at least 8%.

The age hardened steel strip may be batch annealed at a temperature greater than 450° C. between 15 and 50 hours. The age hardened steel strip by batch annealing may have a yield strength of at least 700 MPa and a total elongation of at least 8%.

Alternatively, the age hardened cast strip may be in-line annealed at a temperature between 450° C. and 800° C. for less than 30 minutes. The age hardened steel strip by in-line annealing may have a yield strength of at least 700 MPa and a total elongation of at least 8%.

Also disclosed is a weathering steel made by preparing a molten melt producing an as-cast carbon alloy steel strip less or equal to 4 mm in thickness with a corrosion index of at least 6.0 comprising by weight, between 0.02% and 0.08% carbon, less than 0.6% silicon, between 0.2% and 2.0% manganese, less than 0.03% phosphorus, less than 0.01% sulfur, less than 0.01% nitrogen, between 0.2% and 0.5% copper, between 0.01% and 0.2% niobium, between 0.01% and 0.2% vanadium, between 0.1% and 0.4% chromium, between 0.08% and 0.25% nickel, less than 0.01% aluminum, and the remainder iron and impurities from making the molten melt; solidifying and cooling the molten melt into a cast strip less than or equal to 4 mm in thickness in a non-oxidizing atmosphere; hot rolling the cast strip in an austenitic temperature range above $Ar_3$ to between 10% and 50% reduction; cooling the hot rolled cast strip at above 20° C. per second; coiling the cast strip below 700° C. to form a steel strip with a microstructure comprising bainite and acicular ferrite with more than 70% niobium in solid solution; and age hardening the steel strip forming an age hardened steel strip having a yield strength of at least 550 MPa and a total elongation of at least 8%.

Again, the age hardened steel strip may be batch annealed at a temperature greater than 450° C. between 15 and 50 hours. The age hardened steel strip may have a yield strength of at least 700 MPa and a total elongation of at least 8%. Alternatively, the age hardened cast strip may be in-line annealed at a temperature between 450° C. and 800° C. for less than 30 minutes. The age hardened steel strip may have a yield strength of at least 700 MPa and a total elongation of at least 8%.

BRIEF DESCRIPTION OF THE DRAWINGS

In order that the invention may be described in more detail, some illustrative examples will be given with reference to the accompanying drawings in which:

FIG. 3 is a table showing yield strengths, tensile strengths, and elongations of different coils before and after age-hardening.

DETAILED DESCRIPTION OF THE DRAWINGS

The following description of the embodiments is in the context of high strength thin cast strip with microalloy additions made by continuous casting steel strip using a twin roll caster.

Figure 1:
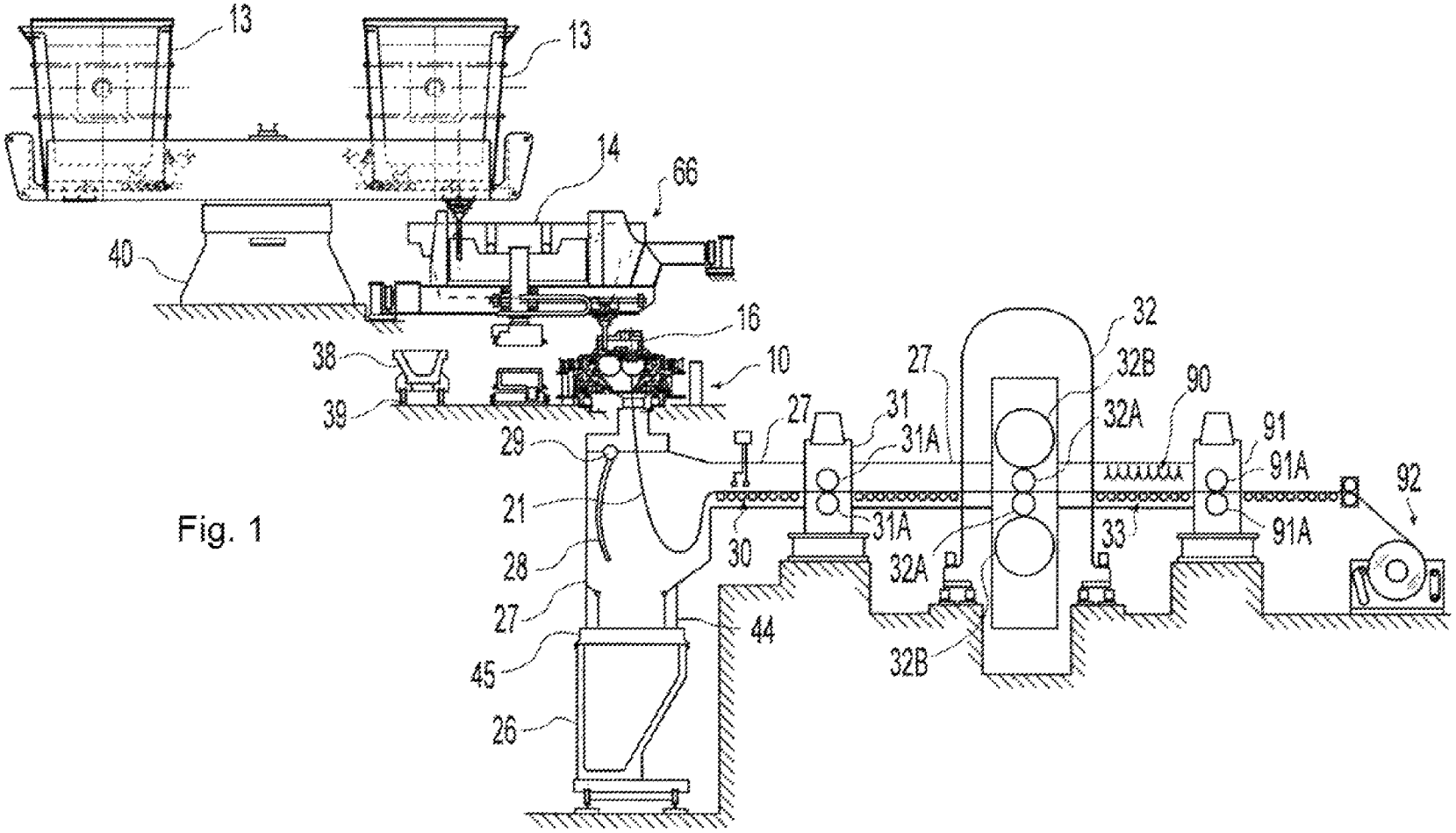
FIG. 1 is a diagrammatical side view of a twin roll caster of the present disclosure.
Figure 2:
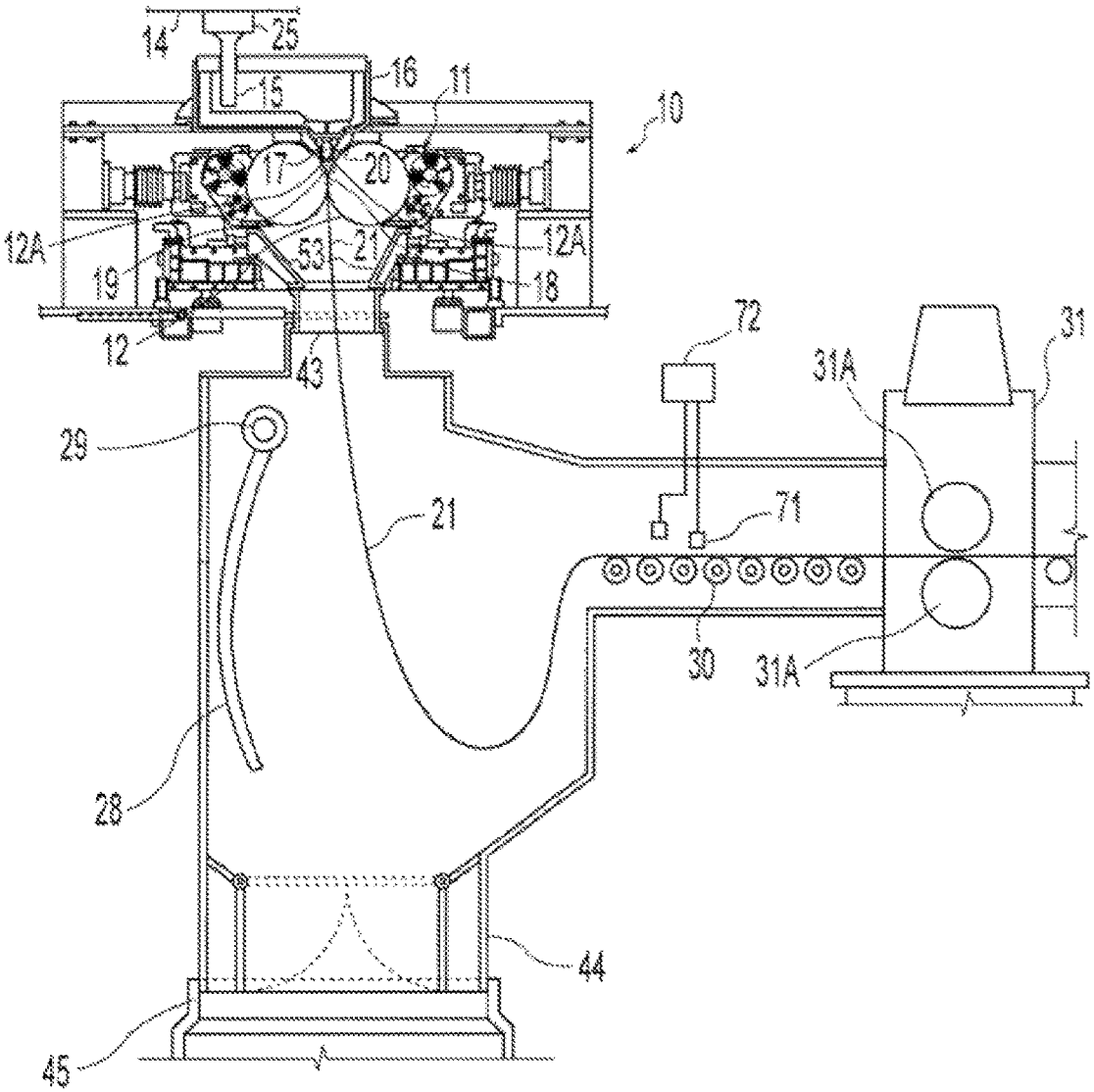
FIG. 2 is an enlarged partial sectional view of a portion of the twin roll caster of FIG. 1 including a strip inspection device for measuring strip profile.
Figure 2A:
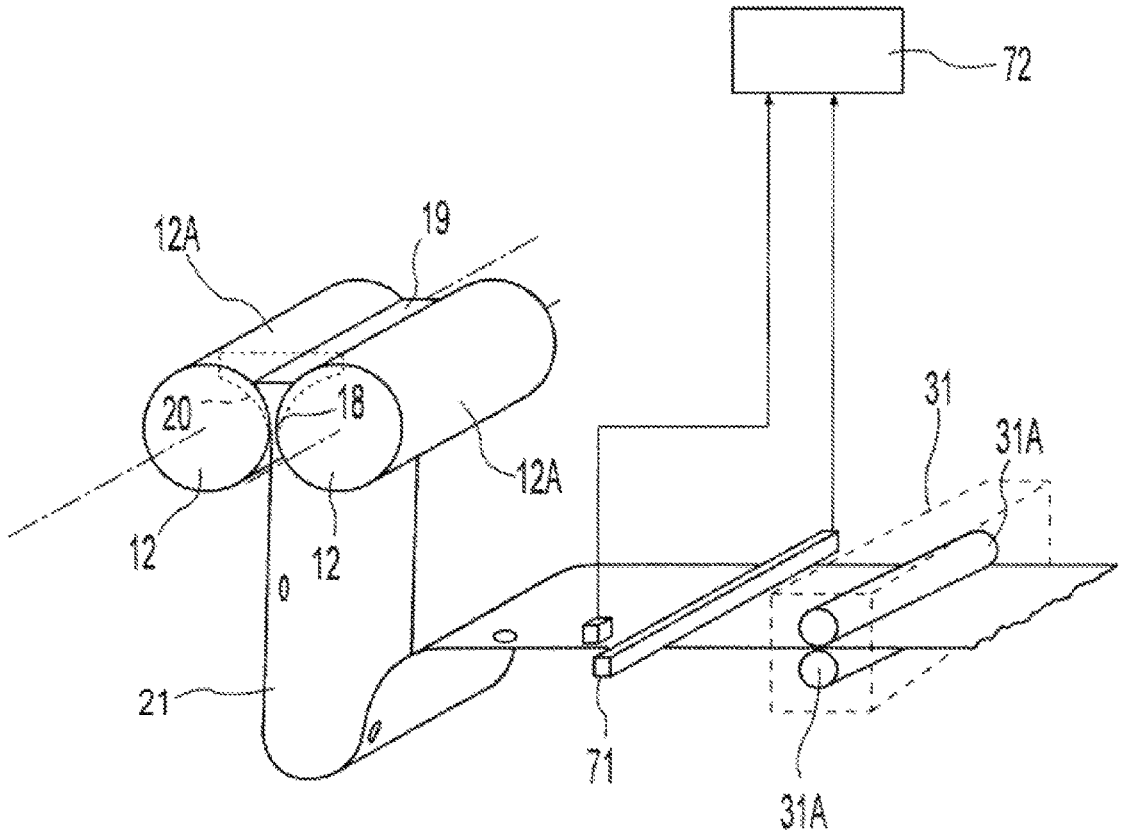
FIG. 2A is a schematic view of a portion of twin roll caster of FIG. 2.

Referring now to FIGS. 1, 2, and 2A, a twin roll caster is illustrated that comprises a main machine frame 10 that stands up from the factory floor and supports a pair of counter-rotatable casting rolls 12 mounted in a module in a roll cassette 11. The casting rolls 12 are mounted in the roll cassette 11 for ease of operation and movement as described below. The roll cassette 11 facilitates rapid movement of the casting rolls 12 ready for casting from a setup position into an operative casting position as a unit in the caster, and ready removal of the casting rolls 12 from the casting position when the casting rolls 12 are to be replaced. There is no particular configuration of the roll cassette 11 that is desired, so long as it performs that function of facilitating movement and positioning of the casting rolls 12 as described herein.

The casting apparatus for continuously casting thin steel strip includes the pair of counter-rotatable casting rolls 12 having casting surfaces 12A laterally positioned to form a nip 18 there between. Molten metal is supplied from a ladle 13 through a metal delivery system to a metal delivery nozzle 17 (core nozzle) positioned between the casting rolls 12 above the nip 18. Molten metal thus delivered forms a casting pool 19 of molten metal above the nip 18 supported on the casting surfaces 12A of the casting rolls 12. This casting pool 19 is confined in the casting area at the ends of the casting rolls 12 by a pair of side closure plates, or side dams 20 (shown in dotted line in FIG. 2A). The upper surface of the casting pool 19 (generally referred to as the "meniscus" level) may rise above the lower end of the delivery nozzle 17 so that the lower end of the delivery nozzle 17 is immersed within the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish 14 with molten metal. The movable tundish 14 may be positioned on a tundish car 66 capable of transferring the tundish 14 from a heating station (not shown), where the tundish 14 is heated to near a casting temperature, to the casting position. A tundish guide, such as rails 39, may be positioned beneath the tundish car 66 to enable moving the movable tundish 14 from the heating station to the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The side dams 20 may be made from a refractory material such as zirconia graphite, graphite alumina, boron nitride, boron nitride-zirconia, or other suitable composites. The side dams 20 have a face surface capable of physical contact with the casting rolls 12 and molten metal in the casting pool 19. The side dams 20 are mounted in side dam holders (not shown), which are movable by side dam actuators (not shown), such as a hydraulic or pneumatic cylinder, servo mechanism, or other actuator to bring the side dams 20 into engagement with the ends of the casting rolls 12. Additionally, the side dam actuators are capable of positioning the side dams 20 during casting. The side dams 20 form end closures for the molten pool of metal on the casting rolls 12 during the casting operation.

FIG. 1 shows the twin roll caster producing the cast strip 21, which passes across a guide table 30 to a pinch roll stand 31, comprising pinch rolls 31A. Upon exiting the pinch roll stand 31, the thin cast strip 21 may pass through a hot rolling mill 32, comprising a pair of work rolls 32A, and backup rolls 32B, forming a gap capable of hot rolling the cast strip 21 delivered from the casting rolls 12, where the cast strip 21 is hot rolled to reduce the strip to a desired thickness, improve the strip surface, and improve the strip flatness. The work rolls 32A have work surfaces relating to the desired strip profile across the work rolls 32A. The hot rolled cast strip 21 then passes onto a run-out table 33, where it may be cooled by contact with a coolant, such as water, supplied via water jets 90 or other suitable means, and by convection and radiation. In any event, the hot rolled cast strip 21 may then pass through a second pinch roll stand 91 having roller 91A to provide tension of the cast strip 21, and then to a coiler 92.

At the start of the casting operation, a short length of imperfect strip is typically produced as casting conditions stabilize. After continuous casting is established, the casting rolls 12 are moved apart slightly and then brought together again to cause this leading end of the cast strip 21 to break away forming a clean head end of the following cast strip 21. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls 12 in enclosure 27 before it passes to the guide table 30 where it engages a succession of guide rollers.

An overflow container 38 may be provided beneath the movable tundish 14 to receive molten material that may spill from the tundish 14. As shown in FIG. 1, the overflow container 38 may be movable on rails 39 or another guide such that the overflow container 38 may be placed beneath the movable tundish 14 as desired in casting locations. Additionally, an optional overflow container (not shown) may be provided for the distributor 16 adjacent the distributor 16.

The sealed enclosure 27 is formed by a number of separate wall sections that fit together at various seal connections to form a continuous enclosure wall that permits control of the atmosphere within the enclosure 27. Additionally, the scrap receptacle 26 may be capable of attaching with the enclosure 27 so that the enclosure 27 is capable of supporting a protective atmosphere immediately beneath the casting rolls 12 in the casting position. The enclosure 27 includes an opening in the lower portion of the enclosure 27, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure 27 as desired with some tolerable leakage.

A rim portion 45 may surround the opening of the lower enclosure portion 44 and may be movably positioned above the scrap receptacle 26, capable of sealingly engaging and/or attaching to the scrap receptacle 26 in the scrap receiving position. The rim portion 45 may be movable between a sealing position in which the rim portion 45 engages the scrap receptacle 26, and a clearance position in which the rim portion 45 is disengaged from the scrap receptacle 26. Alternately, the caster or the scrap receptacle 26 may include a lifting mechanism to raise the scrap receptacle 26 into sealing engagement with the rim portion 45 of the enclosure 27, and then lower the scrap receptacle 26 into the clearance position. When sealed, the enclosure 27 and scrap receptacle 26 are filled with a desired gas, such as nitrogen, to reduce the amount of oxygen in the enclosure 27 and provide a protective atmosphere for the cast strip 21.

The enclosure 27 may include an upper collar portion 43 supporting a protective atmosphere immediately beneath the casting rolls 12 in the casting position. When the casting rolls 12 are in the casting position, the upper collar portion 43 is moved to the extended position closing the space between a housing portion 53 adjacent the casting rolls 12, as shown in FIG. 2, and the enclosure 27. The upper collar portion 43 may be provided within or adjacent the enclosure 27 and adjacent the casting rolls 12, and may be moved by a plurality of actuators (not shown) such as servo-mechanisms, hydraulic mechanisms, pneumatic mechanisms, and rotating actuators.

The casting rolls 12 are internally water cooled as described below so that as the casting rolls 12 are counter-rotated, shells solidify on the casting surfaces 12A, as the casting surfaces 12A move into contact with and through the casting pool 19 with each revolution of the casting rolls 12. The shells are brought close together at the nip 18 between the casting rolls 12 to produce a thin cast strip product 21 delivered downwardly from the nip 18. The thin cast strip product 21 is formed from the shells at the nip 18 between the casting rolls 12 and delivered downwardly and moved downstream as described above.

A strip thickness profile sensor 71 may be positioned downstream to detect the thickness profile of the cast strip 21 as shown in FIGS. 2 and 2A. The strip thickness sensor 71 may be provided between the nip 18 and the pinch rolls 31A to provide for direct control of the casting roll 12. The sensor may be an x-ray gauge or other suitable device capable of directly measuring the thickness profile across the width of the strip periodically or continuously. Alternatively, a plurality of non-contact type sensors may be arranged across the cast strip 21 at the roller table 30 and the combination of thickness measurements from the plurality of positions across the cast strip 21 are processed by a controller 72 to determine the thickness profile of the strip periodically or continuously. The thickness profile of the cast strip 21 may be determined from this data periodically or continuously as desired.

Currently disclosed is a high strength weathering thin cast strip produced using a twin roll caster and overcoming the shortcomings of conventional light gauge steel products. The currently claimed invention utilizes the elements such as niobium (Nb), vanadium (V), copper (Cu), nickel (Ni), or molybdenum (Mo), or a combination thereof, without the purposeful addition of phosphorus. The residual amount of phosphorus present in the steel composition may be due to, for example, from scrap metal used to charge an electric arc furnace. The currently disclosed high strength thin cast strip and method to produce thereof combine several attributes to achieve a high strength light gauge cast strip by microalloying with these elements.

The currently disclosed high strength weathering thin cast strip is produced by hot rolling without the need for cold rolling to further reduce the strip to the desired thickness. Thus, the high strength thin cast strip overlaps both the light gauge hot rolled thickness ranges and the cold rolled thickness ranges desired. Strip thicknesses may be less than 4 mm, less than 3 mm, less than 2.5 mm, or less than 2.0 mm, and may be in a range of 0.5 mm to 2.0 mm. The strip may be hot rolled in an austenitic temperature range above $Ar_3$ to between 10% and 50% reduction. The strip may be cooled at a rate 20° C. per second and above, and still form a microstructure that is a majority and typically predominantly bainite and acicular ferrite with more than 70% niobium in solid solution and having a yield strength of at least 550 MPa and a total elongation of at least 8%.

After hot rolling, the hot rolled steel strip may be coiled below 700° C. The thin cast steel strip may also be further processed by age hardening the steel strip by batch annealing at a temperature greater than 450° C. in less than 50 hours. The age hardened steel may have a yield strength of at least 700 MPa and a total elongation of at least 8%. Alternatively, the thin cast steel strip may also be further processed by age hardening the steel strip by in-line annealing at a temperature between 450° C. and 800° C. in less than 30 minutes. The age hardened steel may have a yield strength of at least 700 MPa and a total elongation of at least 8%.

For example, a steel composition was prepared by the currently disclosed method comprising 0.05% by weight carbon, 0.37% by weight copper, 0.044% by weight niobium, 0.033% by weight vanadium, 0.42% by weight silicon, 0.16% by weight chromium, 0.16% by weight nickel, 1.65% by weight manganese, 0.002% by weight aluminum and a residual amount of 0.017% by weight phosphorus. The cast strip was hot rolled at a temperature 1150° C. to a reduction between 10% and 50%. The hot rolled cast strip was coiled at coiling temperatures between 465° C. and 500° C. and age hardened. This composition produced a calculated corrosion index of 6.3 following the procedure of ASTM G101, Standard Guide for Estimating the Atmospheric Corrosion Resistance of Low Alloy Steels.

Further, examples of yield strengths, tensile strengths, and percent elongations achieved with the currently disclosed method are shown in FIG. 3. Before age-hardening, yield strengths, tensile strengths and elongations were measured for four different coils. Then, each coil was age hardened in a batch-annealed furnace at 510° C. for 30 hours soak and yield strengths, tensile strengths, and elongations were again measured throughout the length of each coil. As illustrated in FIG. 3, the present method not only results in increasing yield strengths and tensile strengths, but also uniformity throughout the length of the coil. For example, before age hardening, Coil #1 had a yield strength of 641 MPa and a tensile strength of 731 MPa. After age-hardening, Coil #1 had an average yield strength of 797 MPa for an increase in yield strength of 156 MPa; and an average tensile strength of 841 MPa for an increase in yield strength of 110 MPa. Similarly, before age-hardening, Coil #2 had a yield strength of 614 MPa and a tensile strength of 738 MPa. After age-hardening, Coil #2 had an average yield strength of 779 MPa for an increase in yield strength of 165 MPa; and an average tensile strength of 820 MPa for an increase in yield strength of 83 MPa. It also should be noted that the currently disclosed method results in minimal change in percent elongation.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed:

1. The method of making weathering steel comprising the steps of:

a. preparing a molten melt producing an as-cast carbon alloy steel strip less or equal to 4 mm in thickness with a corrosion index of at least 6.0 comprising, by weight, between 0.02% and 0.08% carbon, less than 0.6% silicon, between 0.2% and 2.0% manganese, less than 0.03% phosphorus, less than 0.01% sulfur, less than 0.01% nitrogen, between 0.2% and 0.5% copper, between 0.01% and 0.2% niobium, between 0.01% and 0.2% vanadium, between 0.1% and 0.4% chromium, between 0.08% and 0.25% nickel, less than 0.01% aluminum, and the remainder iron and impurities from making the molten melt;

b. solidifying and cooling the molten melt into a cast strip less than or equal to 4 mm in thickness in a non-oxidizing atmosphere;

c. hot rolling the cast strip in an austenitic temperature range above $Ar_3$ to between 10% and 50% reduction;

d. cooling the hot rolled cast strip at above 20° C. per second and coiling the cast strip below 700° C. to form a steel strip with a microstructure comprising bainite and acicular ferrite with more than 70% niobium in solid solution; and e. age hardening the steel strip forming an age hardened steel strip having a yield strength of at least 550 MPa and a total elongation of at least 8%.

2. The method of making a weathering steel as claimed in claim 1 where the age hardened steel strip is batch annealed at a temperature greater than 450° C. between 15 and 50 hours.

3. The method of making a weathering steel as claimed in claim 2 where the age hardened steel strip has a yield strength of at least 700 MPa and a total elongation of at least 8%.

4. The method of making a weathering steel as claimed in claim 1 where the age hardened cast strip is in-line annealed at a temperature between 450° C. and 800° C. for less than 30 minutes.

5. The method of making a weathering steel as claimed in claim 4 where the age hardened steel strip has a yield strength of at least 700 MPa and a total elongation of at least 8%.

6. A method of continuously casting weathering steel comprising the steps of:

a. assembling a pair of counter-rotatable casting rolls to form a nip there between through which a thin strip can be casted, and capable of supporting a casting pool of molten metal formed on casting surfaces of the casting rolls above the nip with a pair of confining side dams adjacent the ends of the casting rolls;

b. assembling a delivery system with metal delivery nozzle or nozzles disposed axially above the nip and capable of discharging molten metal to form the casting pool supported on the casting rolls;

c. solidifying the molten metal delivered from the casting pool on the casting surfaces of the casting rolls in a non-oxidizing atmosphere and forming at the nip between the casting rolls a cast strip delivered downwardly that is less than 4 mm in thickness with a corrosion index of at least 6.0 comprising, by weight, of between 0.02% and 0.08% carbon, less than 0.6% silicon, between 0.2% and 2.0% manganese, less than 0.03% phosphorus, less than 0.01% sulfur, less than 0.01% nitrogen, between 0.2% and 0.5% copper, between 0.01% and 0.2% niobium, between 0.01% and 0.2% vanadium, between 0.1% and 0.4% chromium, between 0.08% and 0.25% nickel, less than 0.01% aluminum, and the remainder iron and impurities from melting;

d. hot rolling the cast strip in an austenitic temperature range above $Ar_3$ to between 10% and 50% reduction;

e. cooling the hot rolled cast strip at above 20° C. per second and coiling the cast strip below 700° C. to form a steel strip with a microstructure comprising bainite and acicular ferrite with more than 70% niobium in solid solution; and f. age hardening the steel strip forming an age hardened steel strip having a yield strength of at least 550 MPa and a total elongation of at least 8%.

7. The method of continuously casting weathering steel as claimed in claim 6 where the age hardened steel strip is batch annealed at a temperature greater than 450° C. between 15 and 50 hours.

8. The method of continuously casting weathering steel as claimed in claim 7 where the age hardened steel strip has a yield strength of 700 MPa and a total elongation of at least 8%.

9. The method of continuously casting weathering steel as claimed in claim 6 where the age hardened cast strip is in line annealed at a temperature between 450° C. and 800° C. for less than 30 minutes.

10. The method of continuously casting weathering steel as claimed in claim 9 where the age hardened steel strip has a yield strength of 700 MPa and a total elongation of at least 8%.

11. A weathering steel made by steps comprising:

a. preparing a molten melt producing an as-cast carbon alloy steel strip less or equal to 4 mm in thickness with a corrosion index of at least 6.0 comprising by weight, between 0.02% and 0.08% carbon, less than 0.6% silicon, between 0.2% and 2.0% manganese, less than 0.03% phosphorus, less than 0.01% sulfur, less than 0.01% nitrogen, between 0.2% and 0.5% copper, between 0.01% and 0.2% niobium, between 0.01% and 0.2% vanadium, between 0.1% and 0.4% chromium, between 0.08% and 0.25% nickel, less than 0.01% aluminum, and the remainder iron and impurities from making the molten melt;

b. solidifying and cooling the molten melt into a cast strip less than or equal to 4 mm in thickness in a non-oxidizing atmosphere;

c. hot rolling the cast strip in an austenitic temperature range above $Ar_3$ to between 10% and 50% reduction;

d. cooling the hot rolled cast strip at above 20° C. per second and coiling the cast strip below 700° C. to form a steel strip with a microstructure comprising bainite and acicular ferrite with more than 70% niobium in solid solution; and e. age hardening the steel strip forming an age hardened steel strip having a yield strength of at least 550 MPa and a total elongation of at least 8%.

12. The weathering steel as claimed in claim 11 where the age hardened steel strip is batch annealed at a temperature greater than 450° C. between 15 and 50 hours.

13. The weathering steel as claimed in claim 12 where the age hardened steel strip has a yield strength of at least 700 MPa and a total elongation of at least 8%.

14. The weathering steel as claimed in claim 11 where the age hardened steel strip is in line annealed at a temperature between 450° C. and 800° C. for less than 30 minutes.

15. The weathering steel as claimed in claim 14 where the age hardened steel strip has a yield strength of at least 700 MPa and a total elongation of at least 8%.

16. A weathering steel made by steps comprising:

a. assembling a pair of counter-rotatable casting rolls to form a nip there between through which thin strip can be casted, and capable of supporting a casting pool of molten metal formed on casting surfaces of the casting rolls above the nip with a pair of confining side dams adjacent the ends of the casting rolls, b. assembling a metal delivery system with a metal delivery nozzle or nozzles disposed axially above the nip and capable of discharging molten metal to form the casting pool supported on the casting rolls;

c. solidifying molten metal delivered from the casting pool on the casting surfaces of the casting rolls in a non-oxidizing atmosphere and forming at the nip between the casting rolls a cast strip delivered downwardly that is less or equal to 4 mm in thickness with a corrosion index of at least 6.0 comprising by weight, of between 0.02% and 0.08% carbon, less than 0.6% silicon, between 0.2% and 2.0% manganese, less than 0.03% phosphorus, less than 0.01% sulfur, less than 0.01% nitrogen, between 0.2% and 0.5% copper, between 0.01% and 0.2% niobium, between 0.01% and 0.2% vanadium, between 0.1% and 0.4% chromium, between 0.08% and 0.25% nickel, less than 0.01% aluminum, and the remainder iron and impurities from the melting;

d. hot rolling the cast strip in an austenitic temperature range above $Ar_3$ to between 10% and 50% reduction;

e. cooling the hot rolled cast strip at above 20° C. per second and coiling the cast strip below 700° C. to form a steel strip with a microstructure comprising bainite and acicular ferrite and more than 70% niobium in solid solution; and f. age hardening the steel strip forming an age hardened steel strip having a yield strength of at least 550 MPa and a total elongation of at least 8%.

17. The weathering steel as claimed in claim 16 where the age hardened steel strip is batch annealed at a temperature greater than 450° C. between 15 and 50 hours.

18. The weathering steel as claimed in claim 17 where the age hardened steel strip has a yield strength of 700 MPa and a total elongation of at least 8%.

19. The weathering steel as claimed in claim 16 where the age hardened steel strip is in line annealed at a temperature between 450° C. and 800° C. for less than 30 minutes.

20. The weathering steel as claimed in claim 19 where the age hardened steel strip has a yield strength of 700 MPa and a total elongation of at least 8%.

* * * * *